United States Patent [19]

Sloan

[11] Patent Number: 4,606,704

[45] Date of Patent: Aug. 19, 1986

[54] WELL POINT SYSTEM AND APPARATUS

[76] Inventor: Albert H. Sloan, 4201 Kean Rd., Ft. Lauderdale, Fla. 33314

[21] Appl. No.: 689,188

[22] Filed: Jan. 7, 1985

[51] Int. Cl.[4] ..... F04B 23/08; F04B 17/00; F04B 35/00; F01D 25/00

[52] U.S. Cl. ..... 417/199 A; 417/364; 415/122 R; 415/219 C

[58] Field of Search ..... 417/199 A, 200, 364; 415/122, 219 C

[56] References Cited

U.S. PATENT DOCUMENTS

| | | | |
|---|---|---|---|
| 1,768,210 | 6/1930 | Nagy | 415/122 |
| 2,674,193 | 4/1954 | Richardson | 415/122 |
| 4,029,438 | 6/1977 | Sloan | 417/200 |
| 4,190,400 | 2/1980 | Sloan | 415/219 C |
| 4,249,865 | 2/1981 | Sloan | 417/200 |
| 4,373,860 | 2/1983 | Sloan | 417/219 C |

FOREIGN PATENT DOCUMENTS

| | | | |
|---|---|---|---|
| 503310 | 4/1939 | United Kingdom | 417/200 |
| 2124302 | 2/1984 | United Kingdom | 417/200 |

*Primary Examiner*—William L. Freeh
*Attorney, Agent, or Firm*—James E. Nilles

[57] ABSTRACT

Well point pumping apparatus and system of the portable type and which includes a power source, an enclosed tank, an impeller type water pump assembly in the tank which has its driven shaft arranged in a vertical direction so that water always positively is fed by gravity into the upwardly facing inlet eye of the pump, and a right angle gear unit drivingly connects the horizontal shaft of the power source with the vertical shaft of the impeller pump. The entire apparatus is mounted as an integral unit for being located closely adjacent the site to be dewatered. The apparatus includes a vacuum pump which is used to create a vacuum in the tank and thereby induce water to flow into the tank from the well points driven into the ground to be dewatered.

13 Claims, 8 Drawing Figures

WELL POINT SYSTEM AND APPARATUS

BACKGROUND OF THE INVENTION

This invention pertains to a water pumping system and apparatus for pumping water out of the ground, for example, prior to excavating the area and which may include a series of well points installed in an area of the ground which is to be dewatered or dried out.

In the co-pending application, Ser. No. 497,838, filed May 25, 1983, now U.S. Pat. No. 4,515,517 which issued May 7, 1985 and entitled WELLPOINT SYSTEM AND APPARATUS, an apparatus and system of the general type to which this invention pertains is shown and described. The subject matter of that application is directed to a portable pumping apparatus which is located directly adjacent the work area but the power for driving that apparatus is remotely located at some distance away and is connected thereto to hydraulic lines. Furthermore, that prior art system utilized a hydraulic drive which, among other things, required seals and bearings for the driven impeller and which were located in the chamber containing the water to be pumped. This arrangement necessitated expensive construction and presented maintenance which are not found in the present invention.

Other U.S. patents relating to this general type of apparatus are U.S. Pat. No. 4,373,860 issued Feb. 15, 1983 and entitled SUBMERSIBLE HYDRAULIC PUMP OF THE AXIALLY DIRECTED INLET AND TANGENTIAL OUTLET TYPE, U.S. Pat. No. 4,190,400, issued Feb. 26, 1980 and entitled INTEGRAL PUMP AND DRIVE SHAFT ASSEMBLY, U.S. Pat. No. 4,249,865 issued Feb. 10, 1981 and entitled CONTROL MEANS FOR PREVENTING WATER OVERFLOW INTO VACUUM TYPE PRIMING PUMP.

SUMMARY OF THE PRESENT INVENTION

The present invention provides wellpoint pumping apparatus and a system in which the apparatus is portable and self-contained as a single unit. The apparatus includes a power source, enclosed tank means having a water inlet and a water outlet, an impeller type water pump assembly is in the tank means and has a vertical axis of rotation so that the inlet eye of the pump faces upwardly and receives water by gravity, and a right angle gear unit is drivingly connected between the power source and the impeller shaft. Thus, the right angle gear unit provides an efficient and effective power drive between the horizontally extending drive shaft of the power source and the vertically extending shaft of the pump impeller. A more specific aspect of the invention relates to a driven vacuum pump that creates a vacuum in the tank means to thereby induct water into the tank means. Control means are provided for the vacuum pump to enable the latter to run continuously but the vacuum pump is rendered inoperative by opening its inlet side to the atmosphere when the water in the tank means reaches a predetermined height. Float switch means in the tank cause the control valve on the inlet side of the vacuum pump to be opened when the water reaches the predetermined level in the tank means. A still further aspect of the invention relates to the above-described apparatus having an air-water separator tank that is connected to the tank means and is also connected to the vacuum pump whereby the latter draws a vacuum in the air-water separator tank and in the tank means. The air-water separator tank functions to separate the water from the air and the water is then conducted back to the tank means, the air being discharged to the atmosphere. Another aspect of the invention relates to apparatus of the above type in which the water pump assembly can be inserted into the tank means as a unit and easily removed for repair or maintenance; means are also provided for rigidly and sealingly securing the impeller pump in the pumping chamber when the pump assembly is secured in place in the tank means.

In the present apparatus there are no anti-friction bearings nor fluid seals in the critical areas, i.e. water tank, thereby eliminating expense and maintenance for such bearings and seals. Instead any bearings and seals are located in the right angle drive unit which is constantly lubricated and sealed from the water tank.

These and other objects and advantages of the present invention will appear hereinafter as this disclosure progresses, reference being had to the accompanying drawings.

DESCRIPTION OF A PREFERRED EMBODIMENT

Figure 1:
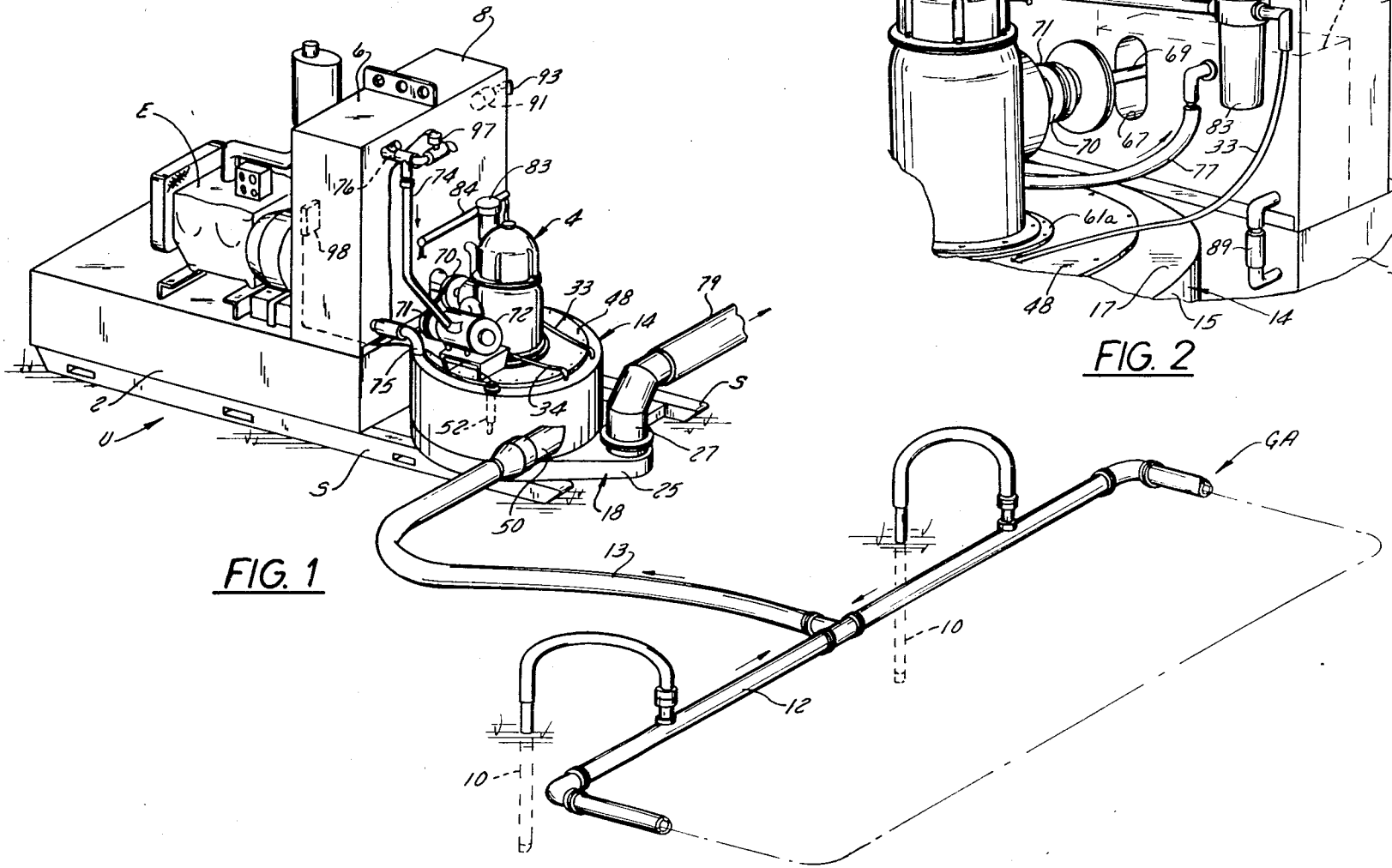
FIG. 1 is a perspective view of the apparatus and system of the present invention, certain parts being shown schematically or broken away for the sake of clarity in the drawings.
Figure 3:
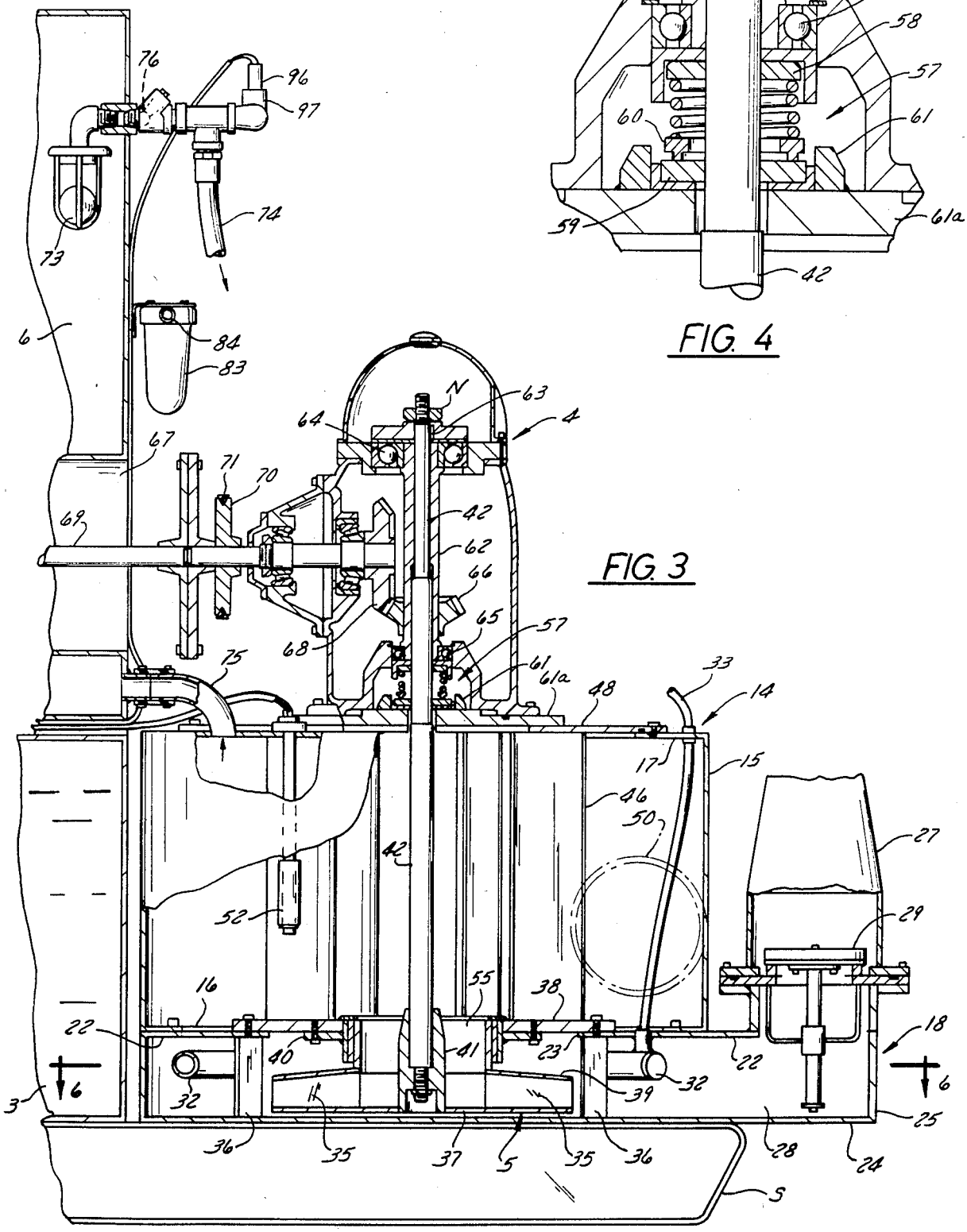
FIG. 3 is an enlarged fragmentary cross-sectional view through the water tank and right angle drive as shown in FIG. 1, certain parts being broken away or removed for the sake of clarity in the drawings.

The well point system and apparatus of the present invention is a self-contained unit which has a power source such as an internal combustion engine E (FIG. 1), a fuel tank 2 and a vacuum pump oil reservoir tank 3. Tanks 2 and 3 are constructed as a single large tank having an internal dividing wall 1 (FIG. 8) which separates the two tanks, and the combined tanks 2, 3 is mounted on ground skids S. The apparatus also includes a right angle gear unit connecting the power source E to a pump impeller 5 (FIG. 3). An air-water separator tank 6 and an oil recovery tank 8 are secured together and mounted on combined tanks 2, 3. The internal combustion engine E is rigidly mounted on top of this combined tank. The combined tank 6, 8 is mounted on combined tanks 2, 3. Also mounted on the ground skids is the large cylindrical water tank 14. Thus a single unit U (FIG. 1) is formed which can be moved directly adjacent the ground area GA to be dewatered.

The area of the ground to be drained of water has a series of well points 10 extending into the ground for extracting water therefrom, and these well points are connected to a header 12 which, in turn, via conduit 13 conveys the water to a water tank 14, by means of the suction induced in the cylindrical water tank 14.

Figure 6:
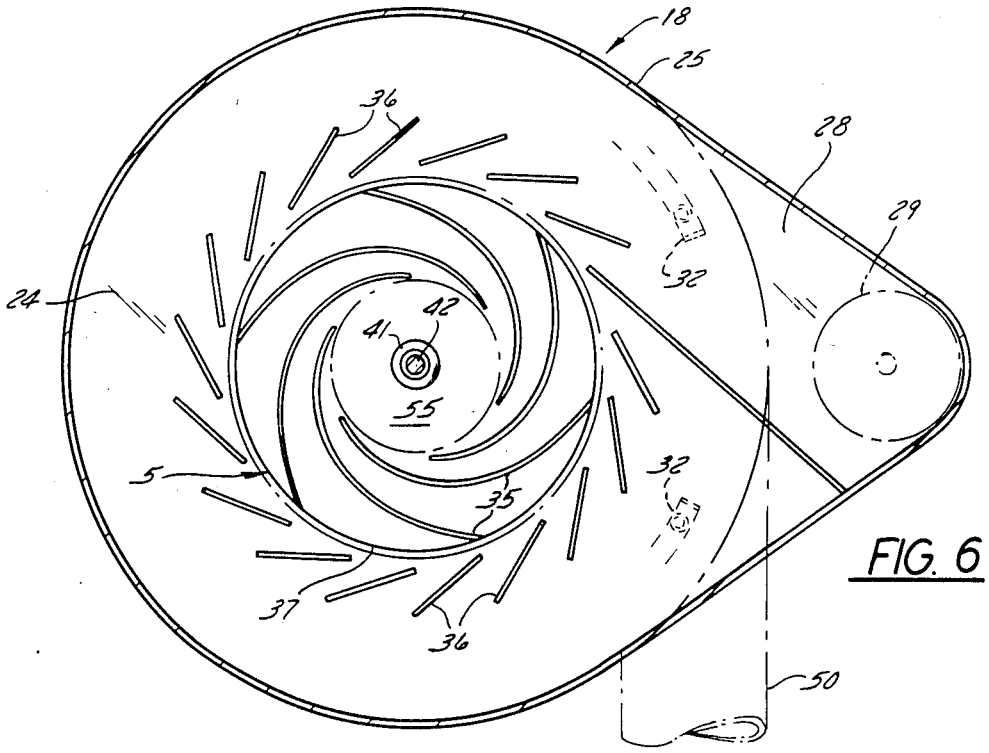
FIG. 6 is a horizontal cross-sectional view taken generally along the lines 6—6 in FIG. 3 and showing the vanes of the impeller and also the vanes in the pump section of the tank, the latter vanes being stationary to direct the radial discharge flow from the impeller.
Figure 7:
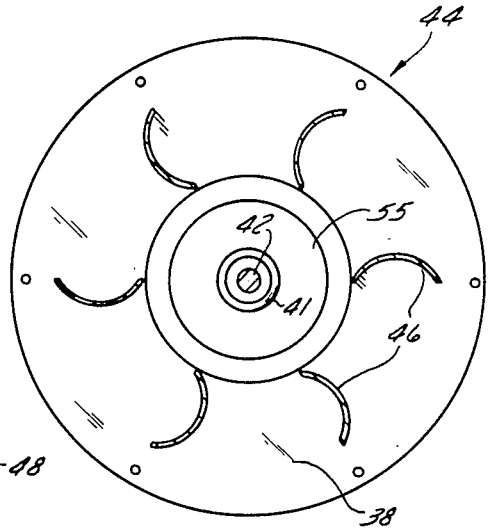
FIG. 7 is a horizontal cross-sectional view taken generally along the lines 7—7 in FIG. 5 and showing the stationary, anti-vortex, curved vanes which are located within the tank.

Water tank 14 (FIG. 3) has a circular side wall 15, a bottom ring plate 16 and a top ring plate 17. A tear shaped housing 18 (FIGS. 3 and 6) is secured to the bottom of ring plate 16 and forms the pumping chamber in which the impeller 5 is rotatably mounted. The impeller 5 has a drive shaft extending upwardly therefrom and which extends into and through the sleeve 19 of the right angle gear drive unit 4.

The top wall 22 (FIG. 3) of the housing 18 has a large central opening 23 for assembly purposes, as will appear. Housing 18 has a bottom wall 24 welded to the side wall 25. The water discharge conduit 27 extends from the pump discharge chamber 28 via one-way valve 29. The housing 18 and its associated parts, such as the outlet discharge conduit 27, heat exchanger 32, and its conduits 33 and 34, anti-vortex vanes 36, the impeller attaching plate 38 and adjusting collar 40 are all shown and described in my said co-pending application Ser. No. 497,838.

The impeller pump comprises an impeller 5 having a plurality of curved blades 35 located between and welded to a lower plate 37 of the impeller and an inclined upper plate 39 (FIG. 3). Six such blades are shown and are of stainless steel, and are tapered in height. The hub 41 of the impeller is secured to and held captive on the vertical impeller shaft 42.

Figure 5:
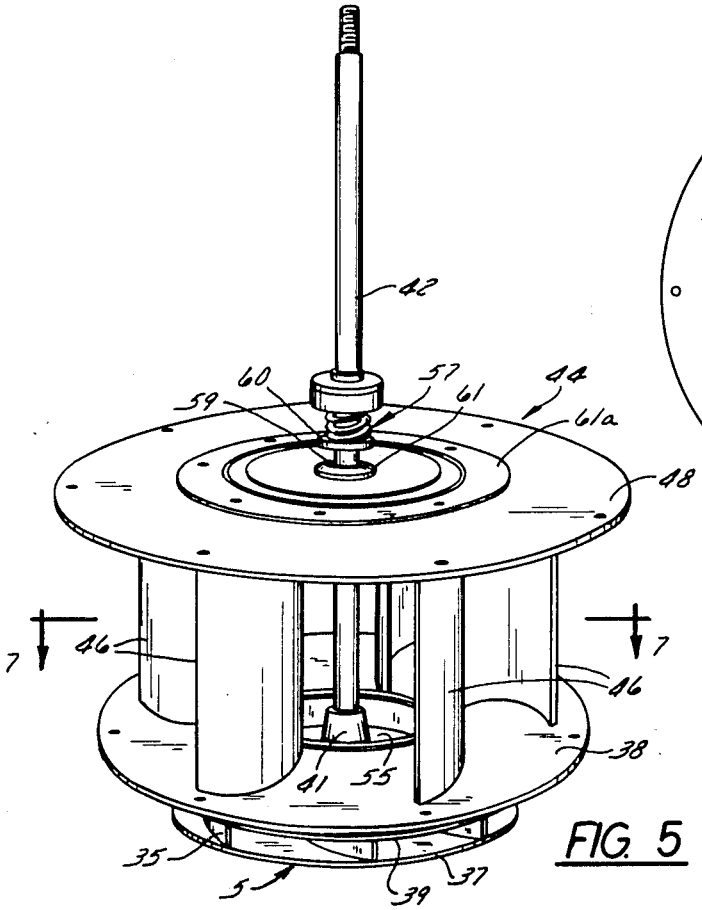
FIG. 5 is a perspective view of a portion of the apparatus which fits inside the water tank and showing the vertical impeller shaft extending from the impeller and upwardly through the anti-vortex vane section.

As shown in FIG. 5, the impeller and its upwardly extending, vertical shaft 42 are assembled with the anti-vortex unit 44 which has curved vanes 46 welded between its lower attaching plate 38 and the circular top mounting plate 48.

Water from the inlet nipple 50 enters the tank 14 tangentially. The tangential inlet causes the water to swirl around the inside of the tank and consequently air that has been entrained in the water has a chance to escape before it enters the impeller.

The water is maintained within a certain level range within the tank by means of a float switch 52 in the tank. Water is fed by gravity downwardly into the eye 55 (FIGS. 3 and 5) of the pump to completely and continuously feed the pump in an efficient manner. The pump impeller discharges water radially into the chamber 28 and thereby creates water pressure in the chamber and the water flows out of the one-way check valve 29 and out of the discharge outlet 27.

The impeller pump works in a high vacuum environment and its impeller 5 is designed specifically for this task. The pump is of the closed impeller type, has a large eye to diameter ratio and is of a low specific speed.

Figure 4:
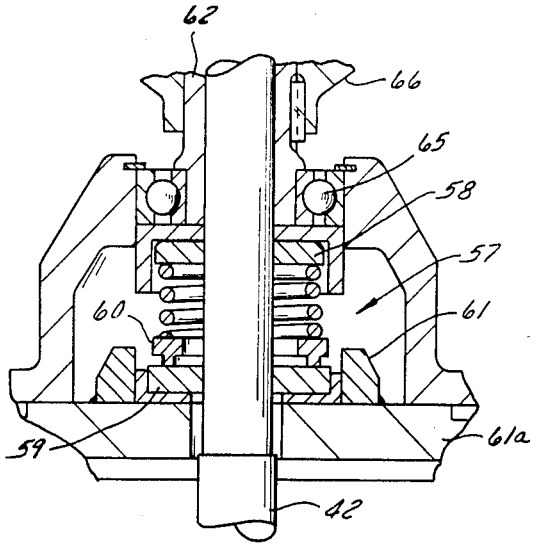
FIG. 4 is a further enlarged, fragmentary, cross-sectional view of a portion of a lower part of the right angle drive unit as shown in FIG. 3 and showing the combination mechanical and fluid seal between the water tank and the right angle drive unit.

The assembly shown in FIG. 5 has a mechanical seal assembly 57 (FIGS. 3, 4 and 5) including the brass bushing ring 58 fixed to shaft 42 and which transfers the load from the shaft to the anti-friction bearing assembly 65. The seal ring 59 has a ground surface for sealing against a bronze ring 60 and is spring loaded against it. Seal holder 61 (FIG. 4) is welded to a mounting plate 61*a*.

In assemblying the apparatus the impeller and anti-vortex assembly of FIG. 5 is lowered through the ring plate 17 of the tank 14, the impeller assembly and its collar 40 pass through opening 23 in plate 22, and attaching plate 38 is bolted to plate 22.

The upper end of impeller shaft 42 is threaded for the reception of an adjusting nut N (FIG. 3) in the right angle drive unit 4 and by means of which the impeller 5 can be vertically and precisely adjusted in its collar 40.

It should be noted that with the present construction as shown in FIG. 3, no seals or bearings are required for the impeller shaft in the water tank and the tank is sealed from the gear drive unit 4, the interior of which is continuously lubricated with oil.

As clearly shown in FIG. 3, impeller shaft 42 extends through the sleeve 62 and is drivingly fixed thereto by a conventional key 63. Shaft 62 is suitably journalled in antifriction bearing assemblies 64 and 65 which are mounted in the housing of the gear unit 4. A bevel gear 66 is fixed to shaft 62 and is in constant mesh with bevel gear 68 fixed to the end of the engine drive shaft 69. Shaft 69 extends through an opening 67 passing through tank 8.

Figure 2:
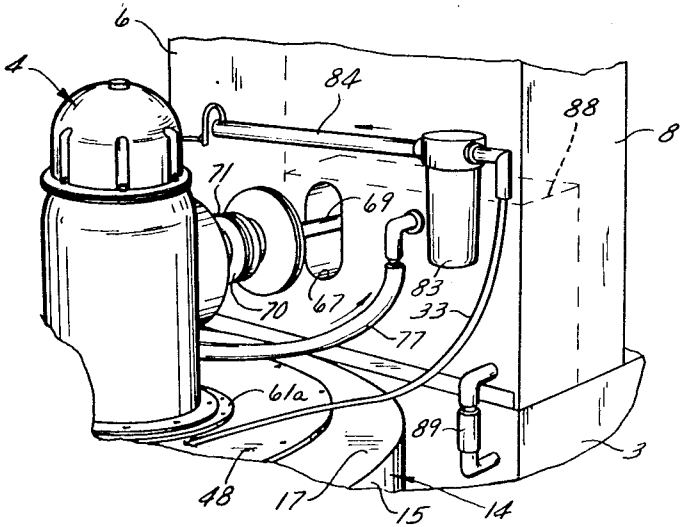
FIG. 2 is an enlarged fragmentary view of a portion of the apparatus shown in FIG. 1, but taken from a different side thereof.

A belt pully 70 is fixed to and driven by the shaft 69 and via belt 71 drives the vacuum pump 72 to be described, and which is mounted on tank 14 and functions to draw a vacuum in tank 8 via conduit 74 (FIGS. 1, 3 and 8) and then in tank 14 via conduit 75 which connects tanks 6 and 14. The one-way ball valve 76 (FIGS. 3 and 8) prevents any water from being drawn into the vacuum pump. The spring loaded one-way check valve 76 in line 74 prevents loss of vacuum in the line. The vacuum pump discharges a mixture of oil and air via conduit 77 (FIGS. 2 and 8) to the oil recovery tank 8.

The vacuum pump 72 is mounted on the upper side of the cylindrical water tank 14 and the lower pressure produced in the water tank 14 causes water from the well point risers and header to be forced into the tank 14 via the inlet nipple 50. This water is discharged by the impeller 5 out the discharge conduit 27 extending from the tank and through the discharge pipe 29 (FIG. 1) to a remote location.

The vacuum pump 72 is driven from the engine shaft 69 through sheave 70 (FIG. 3) fixed thereto and endless, flexible belt 71 which is trained around pulley 82 (FIGS. 1 and 8) which is fixed on the shaft of the pump 72.

Figure 8:
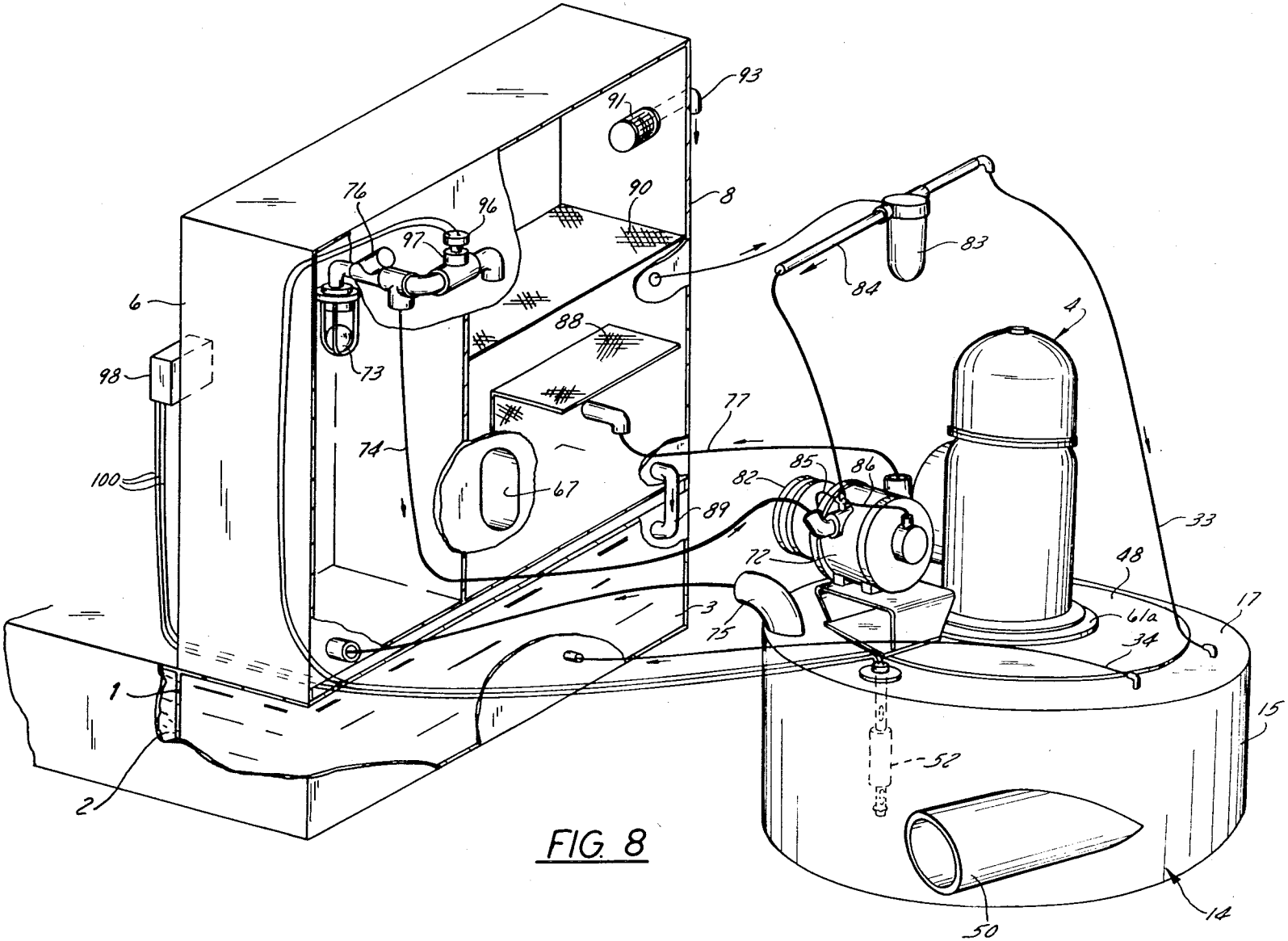
FIG. 8 is a generally schematic, exploded, perspective view of parts of the apparatus and showing the fluid circuits for the vacuum pump including its lubrication/-cooling circuit, and its intake and discharge, and also showing the heat exchanger circuit; the electrical connection between the float switch, the solid state controller and the solenoid of the valve for the vacuum pump is also shown.

The vacuum pump is of the sliding vane type which is constantly flooded with oil from tank 8, filter 83 and via conduits 84, 85 and 86 (FIG. 8) to thereby continually lubricate and cool the vacuum pump. The air is discharged from the vacuum pump along with the cooling oil via the discharge conduit 77 into the tank 8 where the oil is separated from the air. This separation takes place in three stages, for example, by means of a baffle plate 88 in the tank against which the mixture is splashed as it enters the tank. The majority of the oil is then separated from the air and passes out the oil return line 89 (FIG. 8) to the oil reservoir 3. Further separation of the oil from the air occurs as the air passes through a screen 90 located horizontally within the tank 8 (FIG. 8). The remaining mixture is filtered when it passes through the filter 91 within the tank and thus insures that the air is free of oil before it is discharged via nipple 93 to the atmosphere.

In this manner, oil is continually passing through the vacuum pump and lubricates the entire system, including its bearings, and it acts to seal the vanes of the pump for good pumping efficiency and acts to transfer and dissipate heat.

The vacuum pump is driven directly by the engine shaft and at the same speed ratio as the engine. When the water in tank 14 rises above a predetermined limit, the reed type float switch 52 in the tank 14 acts to cause an electric solenoid 96 (FIG. 3) to open a valve 97 located on the inlet side of the vacuum pump. The reed switch and the solenoid are connected through a solid state controller 98 located on the engine side of tank 6 (see FIG. 1). Three wires 100 extend from the float switch 52 and connect with the controller 98 and with the solenoid 96. In this manner when the water in the tank rises to a predetermined limit, the reed switch causes the solenoid to open the valve 97 thereby opening the vacuum tank to the atmosphere and thus rendering the vacuum pump ineffective to continue drawing a vacuum into the tank. This causes the water level in the tank to cease rising. When the water falls to a predetermined limit, the switch 52 again causes the solenoid to close the valve thereby permitting the vacuum pump to again draw a vacuum from the tank 14.

RECAPITULATION

With the apparatus and system of the present invention, an integral self-contained unit is provided and which can be moved adjacent the site to be dewatered. The mechanical right angle gear drive connection between the vertical shaft of the pump impeller and the horizontally extending shaft of the engine provides a dependable and efficient connection that requires a minimum of maintenance. The arrangement is such that no seals or bearings are required in the water tank as with prior art apparatus. The vacuum pump is permitted to run continuously and is simply rendered ineffective by opening its intake side to the atmosphere when the level of the water in the water tank rises beyond a predetermined limit.

The apparatus and system provided by the present invention is particularly efficient in operation, and operates economically with a minimum of amount of fuel and at the same time delivers a great quantity of fluid.

I claim:

1. Well point pumping apparatus of the portable type comprising:

a power source having a generally horizontal power output shaft, a tank on said apparatus, said power source output shaft extending through said tank, enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, and a right angle gear unit drivingly connected between said impeller shaft and power source output shaft whereby said power source drives said impeller to pump water out of said tank means water outlet.

2. The apparatus set forth in claim 1 including:

a driven vacuum pump for creating vacuum in said tank means to thereby induct water into said water inlet chamber through said tank inlet, and a control valve for regulating said vacuum pump, float control means in said tank for causing actuation of said control valve when water reaches a predetermined level in said tank means.

3. The apparatus as described in claim 2 including:

an air-water separator tank having a vacuum drawing conduit connection to said tank means, said tank means having a mounting plate rigidly secured therein and in a generally horizontal direction and adjacent but vertically spaced from said bottom of said tank means, siad mounting plate having a central opening therethrough, said water pump assembly also having an attaching plate, said impeller being received downwardly through said mounting plate central opening, and means for rigidly, sealingly, and removably securing said attaching plate to said mounting plate.

4. Well point pumping apparatus of the portable type comprising:

a power source having a power output shaft, enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, a right angle gear unit drivingly connected between said impeller shaft and power source output shaft whereby said power source drives said impeller to pump water out of said tank means water outlet, an air-water separator tank having a vacuum drawing conduit connection to said tank means, a driven vacuum pump for creating vacuum in said air-water separator tank and tank means to thereby induct water into said water inlet chamber through said tank inlet, a control valve for regulating said vacuum pump, float control means in said tank for causing actuation of said control valve when water reaches a predetermined level in said tank means, an oil recovery tank having an oil receiving conduit connected with the discharge of said vacuum pump whereby a mixture of air and oil are delivered to said oil recovery tank and separated from each other, an oil reservoir tank, an oil conduit between said oil recovery tank and said reservoir tank for the return of separated oil to said reservoir tank, said tank means having a mounting plate rigidly secured therein and in a generally horizontal direction and adjacent but vertically spaced from the bottom of said tank means, said mounting plate having a central opening therethrough, said water pump assembly also having an attaching plate, said impeller being received downwardly through said mounting plate central opening, and means for rigidly, sealingly, and removably securing said attaching plate to said mounting plate.

5. Well point pumping apparatus of the portable type comprising:

a power source having a power output shaft, enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, a right angle gear unit drivingly connected between said impeller shaft and power source output shaft whereby said power source drives said impeller to pump water out of said tank means water outlet, a driven vacuum pump for creating vacuum in said tank means to thereby induct water into said water inlet chamber through said tank inlet, and a float switch means in said tank means for sensing the level of water therein, a solenoid operated valve located on the intake side of said vacuum pump, said valve when open placing said vacuum pump intake in communication with the atmosphere and thereby rendering said vacuum pump ineffective to create a vacuum, and a controller between said float switch means and said solenoid operated valve whereby the latter is actuated by the position of the float switch means, and when water rises to a predetermined level in said tank means, said vacuum pump intake is opened to atmosphere and vacuum is not drawn in said tank means.

6. Well point pumping apparatus of the portable type comprising:

a power source having a power output shaft, enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, a right angle gear unit drivingly connected between said impeller shaft and power source output shaft whereby said power source drives said impeller to pump water out of said tank means water outlet, an air-water separator tank having a vacuum drawing conduit connection to said tank means, a driven vacuum pump for creating vacuum in said air-water separator tank and tank means to thereby induct water into said water inlet chamber through said tank inlet, a float switch means in said tank means for sensing the level of water therein, a solenoid operated valve located on the intake side of said vacuum pump, said valve when open placing said vacuum pump intake in communication with the atmosphere and thereby rendering said vacuum pump ineffective to create a vacuum, and a controller between said float switch means and said solenoid operated valve whereby the latter is actuated by the position of the float switch means, and when water rises to a predetermined level in said tank means, said vacuum pump intake is opened to atmosphere and vacuum is not drawn in said tank means.

an oil recovery tank having an oil receiving conduit connected with the discharge of said vacuum pump whereby a mixture of air and oil are delivered to said oil recovery tank and separated from each other, an oil reservoir tank, an oil conduit between said oil recovery tank and said reservoir tank for the return of separated oil to said reservoir tank, said tank means having a mounting plate rigidly secured therein and in a generally horizontal direction and adjacent but vertically spaced from the bottom of said tank means, said mounting plate having a central opening therethrough, said water pump assembly also having an attaching plate, said impeller being received downwardly through said mounting plate central opening, and means for rigidly, sealingly, and removably securing said attaching plate to said mounting plate.

7. A well point pumping system comprising conduit means over an area of ground to be drained of water and having well point means extending into the ground for extracting water therefrom, water pump apparatus connected to said conduit means for pumping water from said conduit means, said apparatus comprising:

enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, a power source having a generally horizontal power output shaft, and a right angle gear unit drivingly connected between said impeller shaft and power source output shaft whereby said power source drives said impeller to pump water out of said tank means water outlet, a tank located between said power source and said right angle gear unit, said power output shaft passing through said tank.

8. The pumping system as set forth in claim 7 including:

a driven vacuum pump for creating vacuum in said tank means to thereby induct water inlet chamber through said tank inlet, and a control valve for regulating said vacuum pump, float control means in said tank for causing actuation of said control valve when water reaches a predetermined level in said tank means.

9. The system set forth in claim 8 including:

an oil recovery tank having an oil receiving conduit connected with the discharge of said vacuum pump whereby a mixture of air and oil are delivered to said oil recovery tank and separated from each other, an oil reservoir tank, and an oil conduit between said oil recovery tank and said reservoir tank for the return of separated oil to said reservoir tank.

10. Well point pumping apparatus of the portable type comprising:

a power source having a power output shaft, enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, and a right angle gear unit drivingly connected between said impeller shaft and power source output shaft whereby said power source drives said impeller to pump water out of said tank means water outlet, a driven vacuum pump for creating vacuum in said tank means to thereby induct water into said water inlet chamber through said tank inlet, and a control valve for regulating said vacuum pump, float control means in said tank for causing actuation of said control valve when water reaches a predetermined level in said tank means, an air-water separator tank having a vacuum drawing conduit connection to said tank means, said tank means having a mounting plate rigidly secured therein and in a generally horizontal direction and adjacent but vertically spaced from said bottom of said tank means, said mounting plate having a central opening therethrough, said water pump assembly also having an attaching plate, said impeller being received downwardly through said mounting plate central opening, and means for rigidly, sealingly, and removably securing said attaching plate to said mounting plate.

11. A well point pumping system comprising conduit means over an area of ground to be drained of water and having well point means extending into the ground for extracting water therefrom, water pump apparatus connected to said conduit means for pumping water from said conduit means, said apparatus comprising:

enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, a power source having a power output shaft, and a right angle gear unit drivingly connected between said impeller shaft and power source output shaft whereby said power source drives said impeller to pump water out of said tank means water outlet, a driven vacuum pump for creating vacuum in said tank means to thereby induct water into said water inlet chamber through said tank inlet, and a control valve for regulating said vacuum pump, float control means in said tank for causing actuation of said control valve when water reaches a predetermined level in said tank means, an oil recovery tank having an oil receiving conduit connected with the discharge of said vacuum pump whereby a mixture of air and oil are delivered to said oil recovery tank and separated from each other, an oil reservoir tank, and an oil conduit between said oil recovery tank and said reservoir tank for the return of separated oil to said reservoir tank.

12. Well point pumping apparatus of the portable type comprising:

an internal combustion engine having a generally horizontal power output shaft, enclosed tank means having a water inlet and a water outlet, said tank means having a water inlet chamber including a bottom, said tank means including a generally cylindrical water tank having its longitudinal axis extending in an upright position and also having a top mounting plate, an impeller type water pump assembly in said water inlet chamber and having a vertical axis of rotation about said vertical axis and located in said water tank, said impeller having an inlet eye facing in an upward direction for the reception of water located in said water tank and entering downwardly into said impeller and by gravity feed thereto, said impeller having an upwardly extending shaft fixed thereto, and a right angle gear unit mounted on said water tank top mounting plate and drivingly connected between said impeller shaft and engine output shaft whereby said internal combustion engine drives said impeller to pump water out of said tank means water outlet, said gear unit having a mechanical seal assembly adjacent said mounting plate and through which said impeller shaft extends, to thereby seal the interior of said unit from the interior of said water tank.

13. A well point pumping system comprising conduit means over an area of ground to be drained of water and having well point means extending into the ground for extracting water therefrom, water pump apparatus connected to said conduit means for pumping water from said conduit means, said apparatus comprising:

enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, a power source having a power output shaft, and a right angle gear unit drivingly connected between said impeller shaft and power source output shaft whereby said power source drives said impeller to pump water out of said tank means water outlet; and driven vacuum pump for creating vacuum in said tank means to thereby induct water into said water inlet chamber through said tank inlet, a control valve for regulating said vacuum pump, float control means in said tank for causing actuation of said control valve when water reaches a predetermined level in said tank means; an oil recovery tank having an oil receiving conduit connected with the discharge of said vacuum pump whereby a mixture of air and oil are delivered to said oil recovery tank and separated from each other, an oil reservoir tank, and an oil conduit between said oil recovery tank and said reservoir tank for the return of separated oil to said reservoir tank; said driven pump acting to also create a vacuum in said air-water separator tank, an air-water separator tank having a vacuum drawing conduit connection to said tank means through which said vacuum is drawn in said tank means, said tank means having a mounting plate rigidly secured therein and in a generally horizontal direction and adjacent but vertically spaced from the bottom of said tank means, said mounting plate having a central opening therethrough, said water pump assembly also having an attaching plate, said impeller being received downwardly through said mounting plate central opening, and means for rigidly, sealingly, and removably securing said attaching plate to said mounting plate.

* * * * *